US010208443B2

(12) United States Patent
Eavenson, Sr. et al.

(10) Patent No.: US 10,208,443 B2
(45) **Date of Patent: *Feb. 19, 2019**

(54) MULTIPLE-STAGE SNOW THROWER

(71) Applicant: MTD PRODUCTS INC, Valley City, OH (US)

(72) Inventors: Jimmy N. Eavenson, Sr., Aurora, OH (US); Axel Schaedler, Olmsted Township, OH (US)

(73) Assignee: MTD PRODUCTS INC., Valley City, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/982,191

(22) Filed: May 17, 2018

(65) Prior Publication Data

US 2018/0266064 A1 Sep. 20, 2018

Related U.S. Application Data

(63) Continuation of application No. 15/446,429, filed on Mar. 1, 2017, now Pat. No. 9,982,405, which is a (Continued)

(51) Int. Cl.
*E01H 5/09* (2006.01)

(52) U.S. Cl.
CPC ..... *E01H 5/09* (2013.01); *E01H 5/096* (2013.01); *E01H 5/098* (2013.01)

(58) Field of Classification Search
CPC ..... E01H 5/09; E01H 5/096; E01H 5/098; E01H 5/045
See application file for complete search history.

(56) References Cited

U.S. PATENT DOCUMENTS 1,790,789 A 2/1931 Bosworth
2,154,353 A * 4/1939 Ploetz ..... E01H 5/096 37/250

(Continued)

FOREIGN PATENT DOCUMENTS

AT 385300 3/1988
DE 3518442 A1 * 1/1986 ..... E01H 5/076

(Continued)

OTHER PUBLICATIONS

Examination Report for corresponding Australian Patent Application No. 2016264201 dated Aug. 17, 2018.

(Continued)

*Primary Examiner* — Jamie L McGowan
(74) *Attorney, Agent, or Firm* — Wegman, Hessler & Vanderburg

(57) ABSTRACT

A multiple-stage snow thrower having a housing, a power supply operatively connected to a plurality of drive shafts for rotating a plurality of stage assemblies. Each stage assembly of the multiple-stage snow thrower is configured to move snow either axially along the axis of rotation or radially away from the axis of rotation. The first stage assembly is configured to expel snow from the housing, thereby throwing the snow away from the snow thrower. The second, third, and fourth stages assemblies are configured to push the snow toward the longitudinal centerline of the housing and then rearwardly toward the first stage assembly.

19 Claims, 6 Drawing Sheets

Related U.S. Application Data continuation of application No. 15/157,998, filed on May 18, 2016, now Pat. No. 9,605,396.

(60) Provisional application No. 62/164,655, filed on May 21, 2015.

(56) References Cited

U.S. PATENT DOCUMENTS

| | | | | |
|---|---|---|---|---|
| 2,482,413 | A | 9/1949 | Gibson | |
| 3,140,768 | A | 7/1964 | Marr | |
| 3,805,421 | A | 4/1974 | Kamlukin | |
| 4,188,738 | A * | 2/1980 | Vohl | E01H 5/098 172/119 |
| 4,251,116 | A | 2/1981 | Young | |
| 4,261,116 | A * | 4/1981 | Kahlbacher | E01H 5/096 37/248 |
| 4,477,989 | A | 10/1984 | Vachon | |
| 5,398,432 | A | 3/1995 | Vohl | |
| D705,271 | S * | 5/2014 | Cmich | D15/11 |
| D705,272 | S * | 5/2014 | Cmich | D15/11 |
| D705,820 | S * | 5/2014 | Cmich | D15/11 |
| 8,844,172 | B2 * | 9/2014 | Cmich | E01H 5/045 37/248 |
| 9,605,396 | B2 * | 3/2017 | Eavenson, Sr. | E01H 5/09 |
| 2004/0139631 | A1 | 7/2004 | Hanafusa | |

FOREIGN PATENT DOCUMENTS

| | | |
|---|---|---|
| DE | 3518442 | 3/1994 |
| JP | S5073424 | 6/1975 |
| WO | 2013154676 | 10/2013 |

OTHER PUBLICATIONS

International Search Report and Written Opinion for International Application No. PCT/US2016/033066 dated Aug. 8, 2016.

* cited by examiner

MULTIPLE-STAGE SNOW THROWER

CROSS-REFERENCE TO RELATED APPLICATIONS

This application is a U.S. Continuation Patent Application of U.S. patent application Ser. No. 15/446,429 filed Mar. 1, 2017, which is a Continuation of U.S. patent application Ser. No. 15/157,998 filed May 18, 2016, which claims benefit of U.S. Provisional Patent Application Ser. No. 62/164,655, filed May 21, 2015, and entitled MULTIPLE-STAGE SNOW THROWER, which are herein incorporated by reference in their entireties.

FIELD OF THE INVENTION

The present invention is directed to snow removal devices, and more particularly, to a snow thrower having multiple distinct stages configured to transferring loosened snow to be thrown from the device in order to clear a surface of snow.

BACKGROUND OF THE INVENTION

Snow removal machines typically include housings with a forward opening through which material enters the machine. At least one rotatable member (auger) is typically positioned and rotatably secured within the housing for engaging and eliminating the snow from within the housing. Snow blower technology is generally focused on (1) a single-stage mechanisms in which rotation of augers, flights, or brushes contact and expel, or throw, the snow in a single motion, or (2) a two-stage mechanism in which rotation of augers move loosened snow toward a separate impeller that expels, or throws, the snow. Impellers are usually devices such as discs and blades that are shaped and configured such that when rotated they receive materials (snow) and then centrifugally discharge the materials through openings in the housings and then into chutes that control and direct the materials. Both the single- and two-stage snow throwers often require significant force to move the snow thrower forward through the snow unless the snow thrower includes a transmission to drive the snow thrower. This resulting forward movement pushes, or otherwise compacts, the snow into the housing if driven forwardly at a pace that is too quick. When this happens, the single- and two-stage snow throwers often bog down or become overburdened due to snow accumulation within the housing.

BRIEF SUMMARY OF THE INVENTION

According to one aspect of the present invention, a multiple-stage snow thrower is provided. The multiple-stage snow thrower includes a frame and a power supply operatively connected to the frame. The multiple-stage snow thrower also includes a first stage assembly located within a housing and operatively connected to the power supply, wherein rotation of the first stage assembly expels snow from the housing. A second stage assembly is operatively connected to the power supply, wherein rotation of the second stage pushes the snow toward the first stage assembly. A third stage assembly is operatively connected to the power supply, wherein rotation of the third stage assembly pushes the snow toward the second stage assembly. A fourth stage assembly is operatively connected to the power supply, wherein rotation of the fourth stage assembly pushes the snow toward the second stage assembly. The fourth stage assembly is independently rotatable relative to the third stage assembly.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
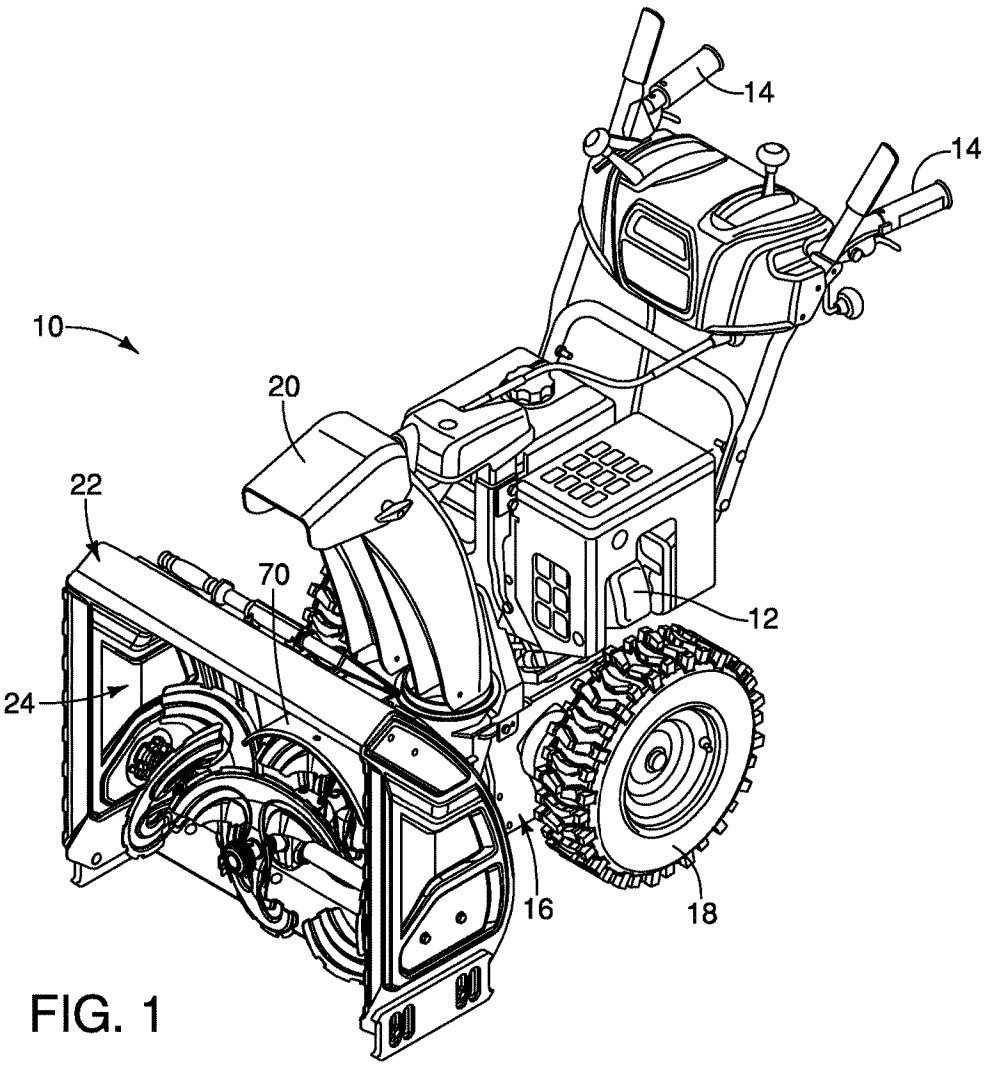
FIG. 1 is top perspective view of a portion of a multiple-stage snow thrower.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Referring to FIG. 1, an exemplary embodiment of a multiple-stage snow thrower 10 is shown. In the illustrated embodiment, the snow thrower 10 includes a power supply 12 configured to provide power, either directly or indirectly, to drive each of the separate stages to remove and expel or throw accumulated snow from concrete, pavement, driveways, sidewalks, and the like. The power supply 12 is shown as an internal combustion engine, but it should be understood by one of ordinary skill in the art that the multiple-stage snow thrower 10 may alternatively be corded to receive electrical power, include a rechargeable battery, be a hybrid gas/electric power, or any other commonly known power supplies. The snow thrower 10 also includes a pair of graspable handles 14 extending from a frame 16, wherein the handles 14 are used by an operator to control the direction and movement of the snow thrower 10. The snow thrower 10 may also include tracks or a pair of wheels 18 for allowing the snow thrower to roll along the ground while removing accumulated snow. The tracks or wheels 18, in some embodiments, are driven by a transmission powered by the power supply 12 and attached to a frame 16. The snow thrower 10 is configured to remove piled-up snow and propel, or throw the snow to a different location via a chute 20 that is operatively connected to the frame 16 into which the piled-up snow enters the snow thrower 10.

Figure 2:
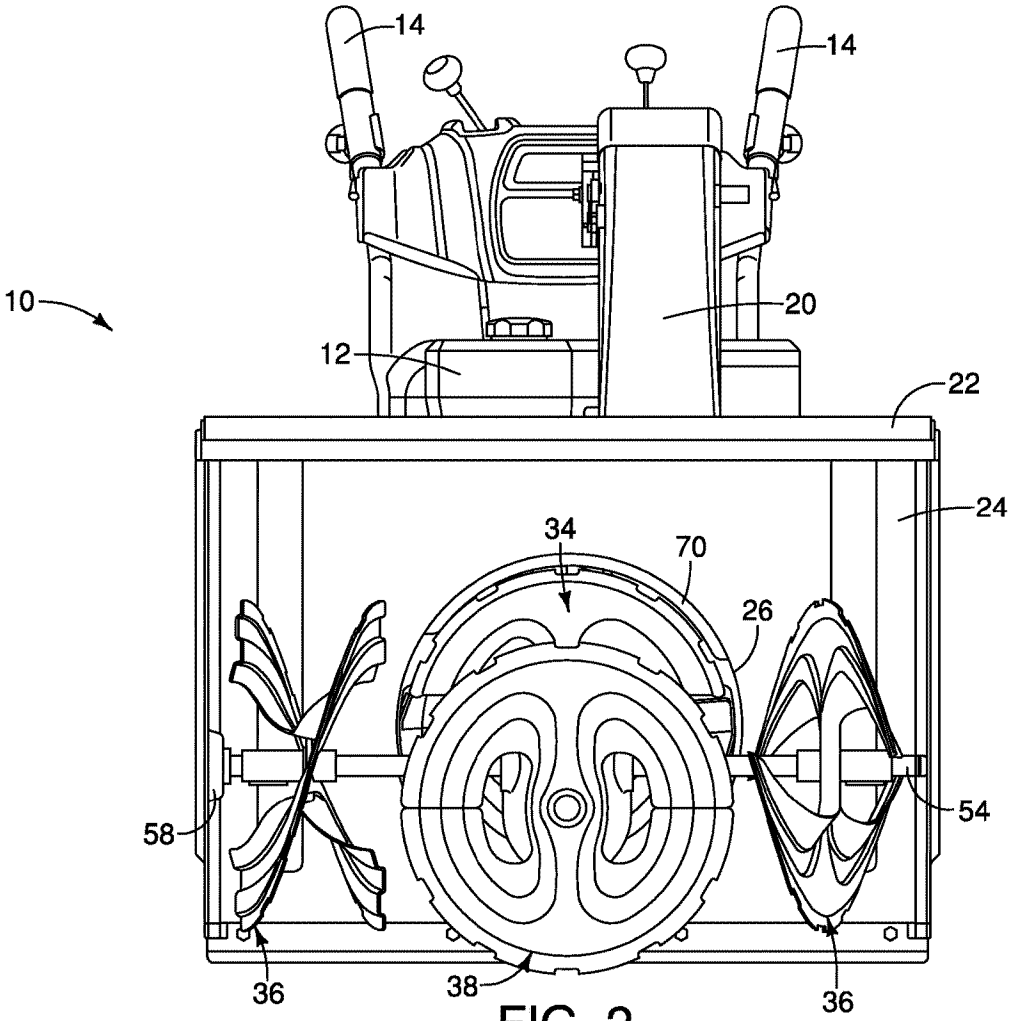
FIG. 2 is a front view of the snow thrower shown in FIG. 1.

The snow thrower 10 includes a housing 22 that is operatively connected to the frame 16 and is formed as a generally semi-cylindrical shape, or C-shaped, as shown in FIGS. 1-2. The housing 22 includes a recess 24 that extends rearwardly from the central C-shaped portion. The housing 22 is laterally oriented with respect to the longitudinal axis and fore/aft movement of the snow thrower 10. The housing 22 is formed of a metal or other material having sufficient strength to withstand lower temperatures as well as the repeated impact of snow and debris during operation of the snow thrower 10. The housing 22 further includes a forwardly-directed opening into which snow enters the housing 22 and rearwardly-directed outlet aperture 26 through which the snow is transferred out of the housing 22 by the first, second, third, and fourth stages of the snow thrower 10, as will be described below. The housing 22 includes the main chamber as well as an expulsion housing 29 (FIG. 4) that is extends from the rear wall of the main chamber such that the expulsion housing 29 extends rearwardly and is fluidly connected with the main chamber through the outlet aperture 26.

In the embodiment illustrated in FIGS. 3A-3B, 4, and 5A-5B, the power supply 12 is operatively connected to a first drive shaft 28 that extends into the housing 22 for providing rotational power to each of the stages of the snow thrower 10 that are interconnected therewith. The power supply 12 selectively drives or rotates the first drive shaft 28, wherein the power supply 12 can cause the first drive shaft 28 to always rotate when the power supply 12 is active, or the operator can selectively determine when the power supply 12 engages or otherwise causes the first drive shaft 28 to rotate. One distal end of the first drive shaft 28 is external to the housing 22 and the opposing distal end of the first drive shaft 28 terminates within, or adjacent to, the gear housing 30. In another embodiment, the first drive shaft 28 may extend longitudinally through the gear housing 30. The first drive shaft 28 is aligned such that the longitudinal axis thereof is substantially aligned with the fore/aft direction and centerline of the multiple-stage snow thrower 10.

The first drive shaft 28 is configured to directly or indirectly drive the first stage assembly 32, the second stage assembly 34, the third stage assembly 36, and a fourth stage assembly 38, wherein rotation of these assemblies cuts through the accumulated snow as well as moves the snow within the housing 22 toward the outlet aperture 26 for expulsion from the housing 22. In other embodiments, the first drive shaft 28 is configured to directly or indirectly drive any number of the first, second, third, and fourth stage assemblies 32, 34, 36, 38, wherein those stage assemblies that are not driven by the drive shaft 28 are driven separately. For example, the first drive shaft 28 can be configured to drive the first, second, and third stage assemblies 32, 34, 36, and the fourth stage assembly 38 is driven by an electric motor or other drive shaft operatively connected to the power source 12. It should be understood by one having ordinary skill in the art that these are only exemplary driven power arrangements and that other alternative driven power divisions and arrangements are contemplated as well.

Figure 3A:
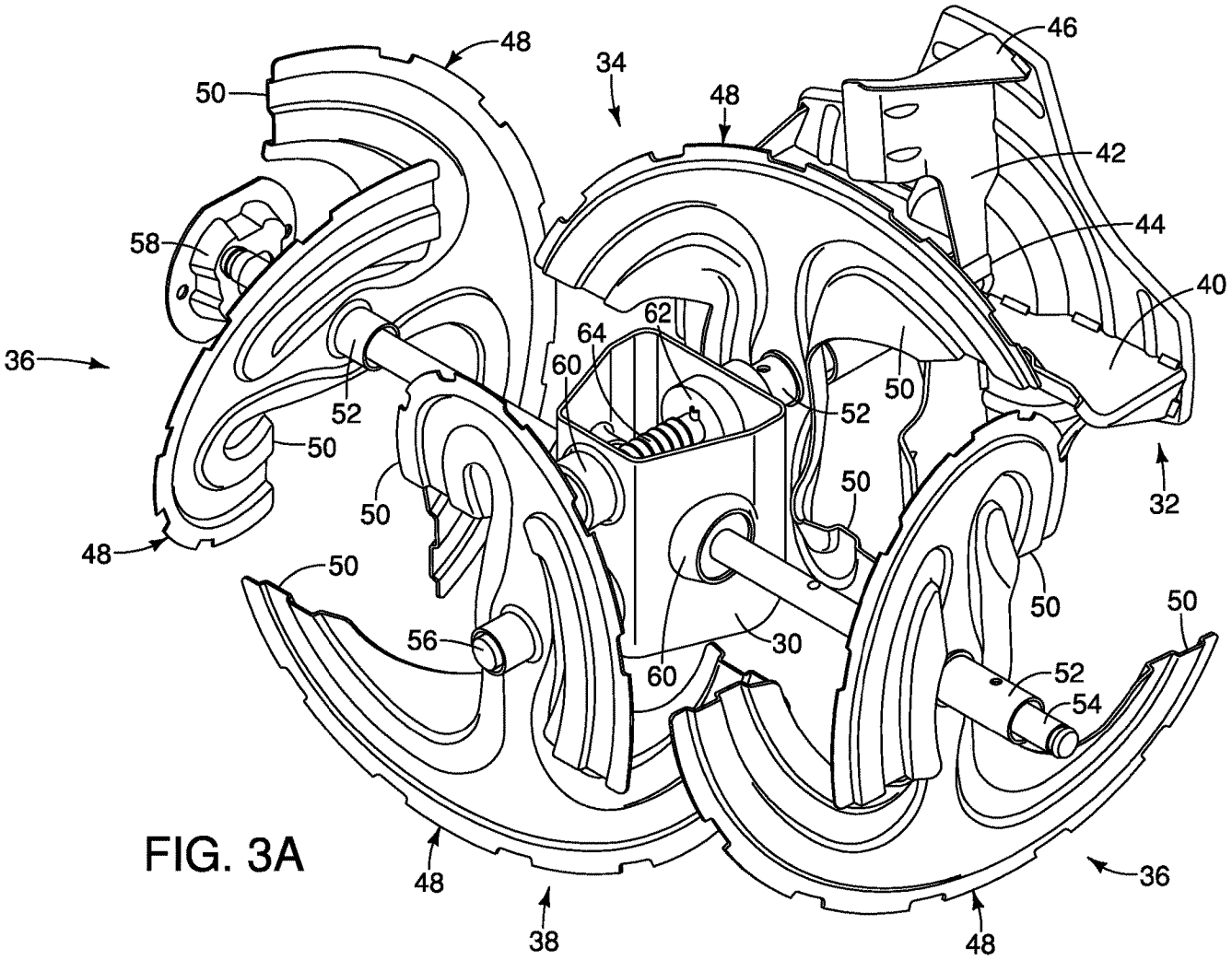
FIG. 3A is a top perspective view of the first, second, third, and fourth stage assemblies.
Figure 3B:
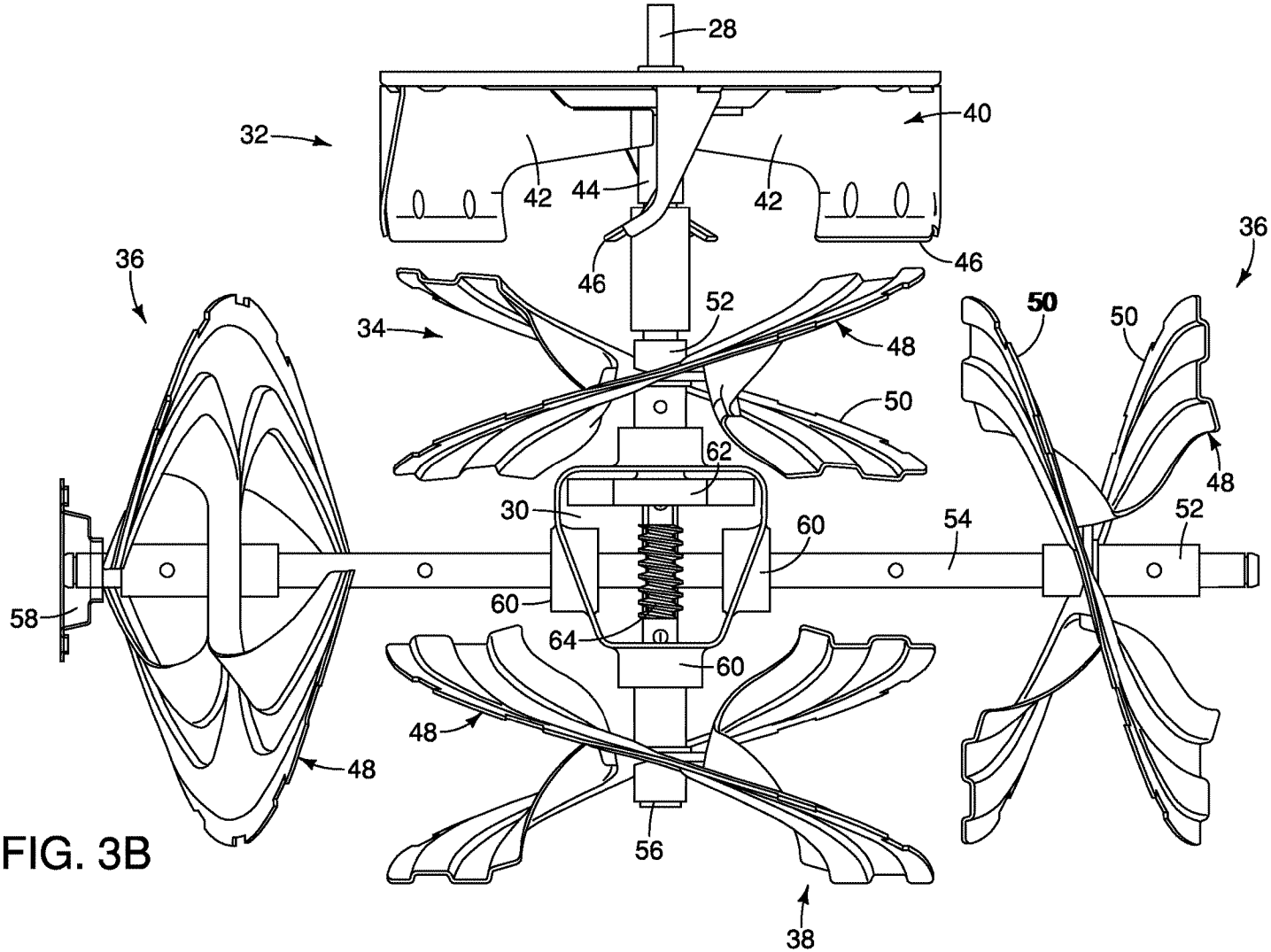
FIG. 3B is a top view of the first, second, third, and fourth stage assemblies.
Figure 4:
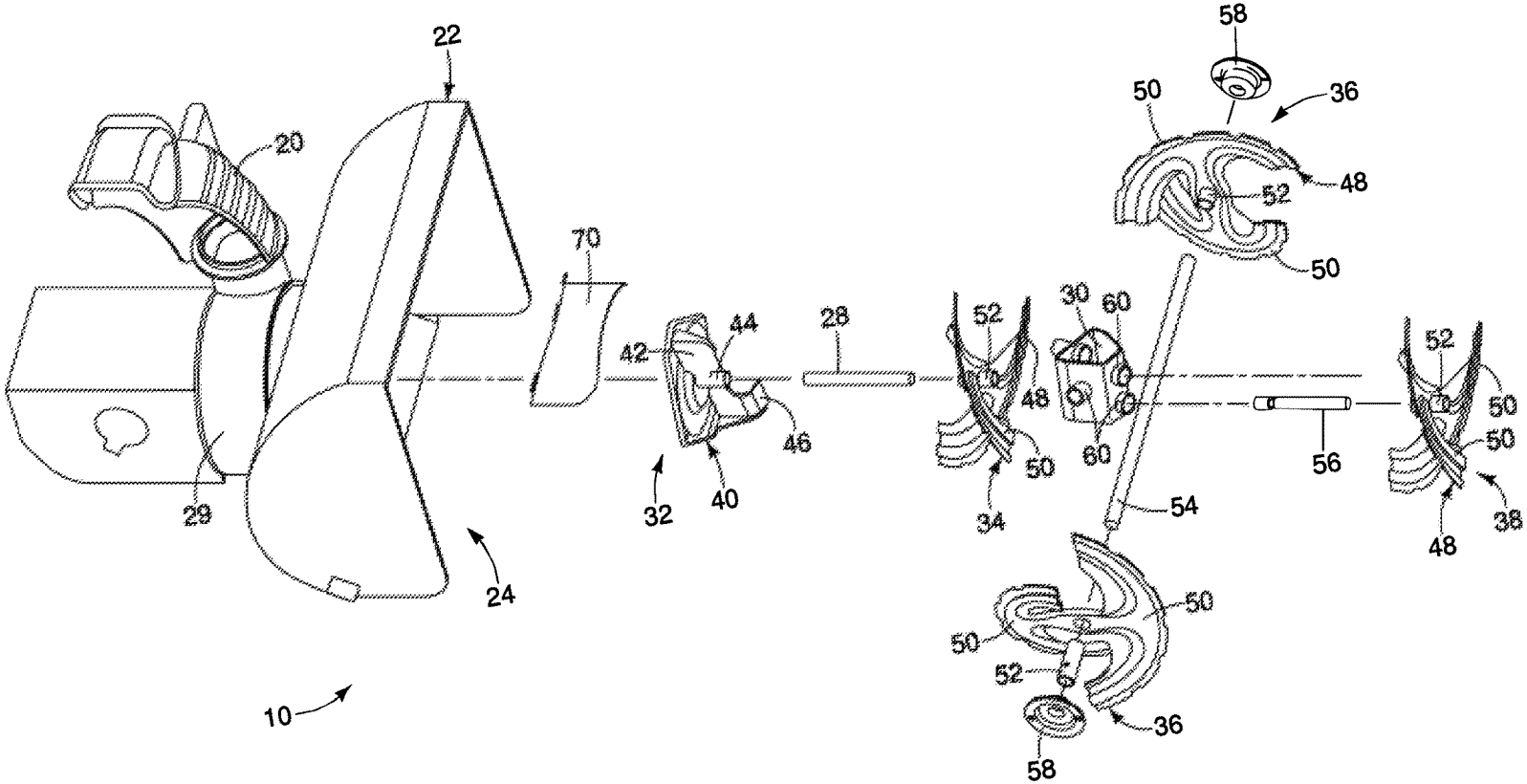
FIG. 4 is an exploded view of the snow thrower.

As shown in FIGS. 3A-3B and 4, the first stage assembly 32 is operatively connected to the first drive shaft 28. The first stage assembly 32 is configured to expel accumulated snow and ice—via the chute 20—that is moved into contact with the first stage assembly 32 within the housing 22. In an embodiment, the first stage assembly 32 is formed as a rotatable impeller 40, wherein the impeller 40 is positioned within the expulsion housing 29 that extends rearwardly from the main chamber of the housing 22. The impeller 40 is positioned between the power supply 12 and the gear housing 30. The impeller 40 is configured to receive the snow from the third stage assembly 34, and through rotation of the impeller 40 about the longitudinal axis defined by the first drive shaft 28 at a sufficient rotational velocity to centrifugally throw or otherwise expel the snow through the chute 20 and away from the snow thrower 10. The impeller 40 is removably attached to the first drive shaft 28 to allow removal and/or replacement of the impeller 40. The impeller 40 can be attached to the first drive shaft 28 using any attachment mechanism such as nut-and-bolt, cotter pin, or the like.

As shown in FIGS. 3A-3B and 4, an exemplary embodiment of an impeller 40 includes a plurality of blades 42 that extend radially outwardly from a base 52, wherein the impeller 40 is attached to the first drive shaft 28 by sliding the base 52 over the outer surface of the first drive shaft 28 and secured thereto. In an embodiment, each blade 42 includes a tip 46 that extends from the end of the blade 42 in a curved manner. The tips 46 are curved in the direction of rotation of the impeller 40. The curved tips 46 assist in maintaining contact between the snow and the blades 42 as the impeller 40 rotates, thereby preventing the snow from sliding past the ends of the blades 42 to the gap between the blades 42 and the inner surface of the expulsion housing 29 before the snow is thrown into and from the chute 20. Preventing the snow from sliding past the end of the blades 42 results in less re-circulation of the snow within the expulsion housing 29, thereby making the snow thrower 10 more efficient in expelling the snow. Whereas the augers of the first, second, and third stage assemblies are configured to push snow axially along the axis of rotation of each respective auger, the impeller 40 is configured to drive or throw snow in a radial direction away from the axis of rotation of the impeller 40.

In the embodiment illustrated in FIGS. 3A-3B and 4, the second stage assembly 34 is operatively connected to the first drive shaft 28 and is located upstream relative to the first stage assembly 32. The second stage assembly 34 is positioned between the first stage assembly 32 and the gear housing 30 and is configured to push or otherwise move snow and ice rearward toward the first stage assembly 32 within the housing 22 to allow the snow and ice to be expelled from the housing 22. The second stage assembly 34 is configured to move snow and ice within the housing 22 in a generally rearward direction (relative to the fore/aft direction of movement of the snow thrower 10), thereby moving snow from the front portion of the housing 22 to the rear of the housing 22. The second stage assembly 34 is configured to be releasably connected to the first drive shaft 28 to allow the second stage assembly 34 to be removed and/or replaced easily. In the illustrated embodiment, the first stage assembly 32 and the second stage assembly 34 rotate at the same rotational velocity because they are both secured to the first drive shaft 28. It should be understood by one having ordinary skill in the art that the first and second stage assemblies 32, 34 may be connected to separate concentrically-oriented drive shafts driven by the power supply, wherein each stage assembly may rotate at a rotational velocity that is different from the other stage assembly.

In an exemplary embodiment, the second stage assembly 34 is formed of a single auger 48. In other embodiments, the second stage assembly 34 includes a plurality of augers 48, wherein each auger 48 is positioned between the first stage assembly 32 and the gear housing 30. It should be understood by one having ordinary skill in the art that the second stage assembly 34 can include any number of augers 48. In some embodiments, the impeller 40 of the first stage assembly 32 and the auger(s) 48 of the second stage assembly 34 are configured to rotate at the same rotational speed. In other embodiments, the impeller 40 of the first stage assembly 32 and the auger(s) 48 of the second stage assembly 34 are configured to rotate ad different rotational speeds. In some embodiments, rotation of the second stage assembly 34 is dependent upon rotation of the first stage assembly 32. In other embodiments, the second stage assembly 34 rotates independently relative to the first stage assembly 32.

Each auger 48 includes at least one flight 50 that extends radially outward from a base 52 as well as extending at least somewhat concentrically with the outer surface of the base 52. In the illustrated embodiment, the flights 50 include a base portion that extends radially from the base 52 in a generally linear manner, and an arc-shaped blade portion that expands from the end of the base portion in a generally semi-circular manner about the base 52. The blade portion of the flight 50 is also curved, or angled in a helical manner about the base 52. The blade portion of each flight 50 extends about the base 52 about one hundred eighty degrees (180) such that two flights 50 extending about the entire periphery of the base 52. In another embodiment, each auger 48 has a single flight 50 that extends helically about the entire periphery of the base 52 in a helical manner. In yet another embodiment, each auger 48 includes more than two flights 50 extending from the base 52 such that all of the flights 50 extend about at least the entire periphery of the base 52. The augers 48 can be formed of segmented or continuous flights 50, or the augers 48 may include brushes incorporated with the flights 50. The augers 48 illustrated are for exemplary purposes, and it should be understood by one having ordinary skill in the art that the augers 48 can be formed in any manner that allows each auger 48 to push snow in a direction generally parallel to the axis of rotation of the auger 48. In other embodiments, the augers 48 are configured in a corkscrew or spiral shape. In operation, the second stage assembly 34 is configure to rotate and push or transport the snow in a direction generally parallel to longitudinal axis of the first drive shaft 28. In embodiments in which the first and second stage assemblies 32, 34 are both attached to the first drive shaft 28, the first and second stage assemblies 32, 34 rotate about a common axis.

In the embodiment of the snow thrower 10 illustrated in FIGS. 3A-3B, 4, and 5A-5B, the first stage assembly 32 and the second stage assembly 34 are operatively connected to the first drive shaft 28. The first drive shaft 28 terminates within or extending through the gear housing 30. The gear housing 30 is a generally rectangular hollow member configured to provide a structural support for receiving the longitudinally-aligned first drive shaft 28, the laterally-aligned second drive shaft 54, and the longitudinally-aligned third drive shaft 56, wherein the transfer of rotational power between the first drive shaft 28, the second drive shaft 54, and the third drive shaft 56 is accomplished within the walls of the gear housing 30. In an embodiment, the gear housing 30 is a fully enclosed member to prevent dirt, debris, or fluids from entering and interfering with the transfer or rotational power between the first, second, and third drive shafts 28, 54, 56. In another embodiment, the gear housing 30 is a generally tubular member having an opening at the top and/or bottom thereof. In an embodiment, the gear housing 30 is formed of a casting, but it should be understood by one having ordinary skill in the art that the gear housing may also be formed of formed metal sheets welded together or any other method of manufacturing a structurally rigid material. The gear housing 30 includes a plurality of bosses 60, wherein each boss 60 is configured to receive a bearing 58 to support the first, second, and third drive shafts 28, 54, 56.

Figure 5B:
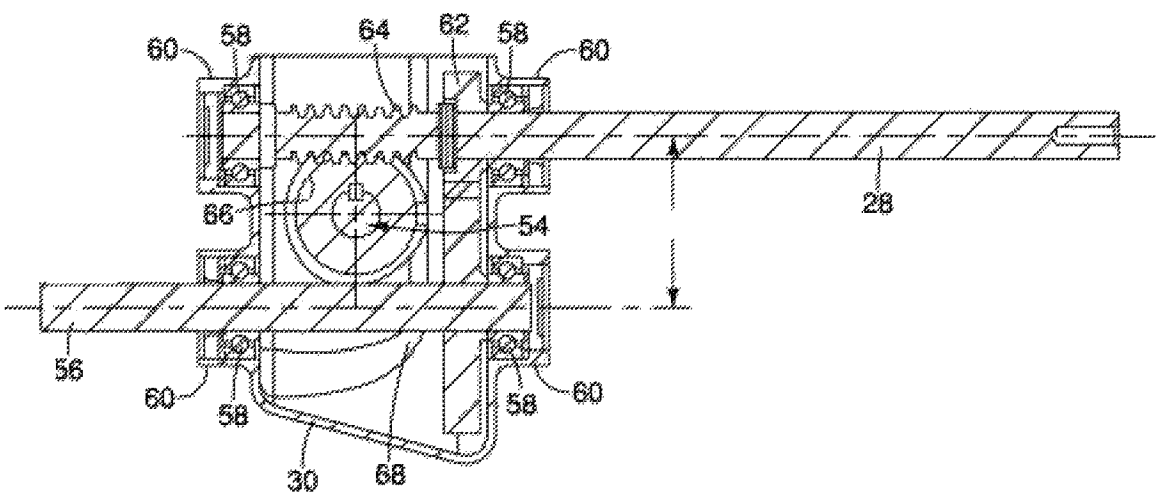
FIG. 5B is a cross-sectional side view of the gear housing and the components located therein.
Figure 5A:
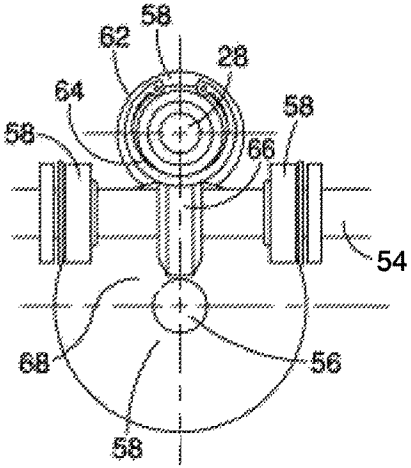
FIG. 5A is a front view of the components located within the gear housing.

In an embodiment, the first drive shaft 28 extends into the gear housing 30, wherein the gear housing 30 includes a first bearing 58 located within the boss 60 located at a downstream position on the first drive shaft 28 and a second bearing 58 is located within the boss 60 that supports the distal end of the first drive shaft 28, as shown in FIGS. 5A-5B. In a similar manner, the gear housing 30 further includes a bearing 58 positioned within a boss 60 at each location of the gear housing 30 through which the second drive shaft 54 enters the gear housing 30. The gear housing 30 also includes a first bearing 58 located within the boss 60 located at an upstream position on the third drive shaft 56 and a second bearing 58 is located within the boss 60 that supports the distal end of the third drive shaft 56. In an embodiment, each of the bearings 58 is formed as the same type of bearing. In the exemplary embodiment, the bearings 58 are formed as ball bearings, but it should be understood by one having ordinary skill in the art that any type of bearing can be used.

The first drive shaft 28 includes a pair of power transfer mechanisms attached thereto, wherein the power transfer mechanisms are configured to transfer rotational power and rotation from the first drive shaft 28 to the second and third drive shafts 54, 56, as shown in FIGS. 3A-3B and 5A-5B. The first transfer mechanism 62 of the first drive shaft 28 is positioned adjacent to the first bearing 58 and the inner surface of the gear housing 30, downstream from the second bearing 58. In the exemplary embodiment, the first transfer mechanism 62 is formed as a pinion gear, wherein the pinion gear includes a plurality of gear teeth directed radially outward and positioned about the circumference of the pinion gear. It should be understood by one having ordinary skill in the art that although the first transfer mechanism 62 is shown as a pinion gear, the first power transfer mechanism 62 can be formed as any other type of mechanical component capable of transferring rotational power and rotation from the first drive shaft 28 to the third drive shaft 56 such as a spiral gear, a bevel gear, a spur gear, a worm gear, a planetary gear, or the like. In an embodiment, the first power transfer mechanism 62 is formed separately from the first drive shaft 28 and subsequently attached thereto. In another embodiment, the first power transfer mechanism 62 is integrally formed with the first drive shaft 28 simultaneously with the formation of the first drive shaft 28. In yet another embodiment, the first power transfer mechanism 62 is formed into the first drive shaft 28 after the first drive shaft 28 is manufactured.

The second power transfer mechanism 64 of the first drive shaft 28 is positioned between the first power transfer mechanism 62 and the distal end of the first drive shaft 28, as shown in FIGS. 4A-4B and 5A-5B. In an embodiment, the second power transfer mechanism 64 is formed as a worm gear formed into the outer surface of the first drive shaft 28. The worm gear includes a plurality of helically-shaped ribs positioned on the outer surface of the first drive shaft 28, wherein the ribs are configured to provide meshing engagement with a corresponding power transfer mechanism. It should be understood by one having ordinary skill in the art that the second power transfer mechanism 64 can be formed as any other type of mechanical component capable of transferring rotational power and rotation from the first drive shaft 28 to the second drive shaft 54 such as a spiral gear, a bevel gear, a spur gear, a worm gear, a planetary gear, or the like. It should also be understood that although the second power transfer mechanism 64 is illustrated as being positioned upstream relative to the first power transfer mechanism 62, the second power transfer mechanism 62 can also be positioned downstream of the first power transfer mechanism 62.

In an embodiment, the second drive shaft 54 extends laterally within the housing 22, wherein the opposing distal ends of the second drive shaft 54 are operatively connected to an inner surface of the housing 22 in a manner that allows the second drive shaft 54 is rotatable relative to the housing 22, as shown in FIGS. 1-5B. The second drive shaft 54 extends the entire width of the housing 22, between both side walls thereof, and passes through the gear housing 30. The gear housing 30 includes a pair of bearings 58 positioned within bosses 60, wherein the bosses 60 provide the openings through which the second drive shaft 54 enters the gear housing 30. In an embodiment in which the lateral drive shaft 54 is formed of two separate shafts that extend into the gear housing 30 from the opposing side walls of the housing 22, a bearing 58 positioned within a corresponding boss 60 is located adjacent to the distal end of each lateral drive shaft within the gear housing 30. A similar rotatable bearing is positioned adjacent to the inner surface of both opposing side walls of the housing 22 to receive a distal end of the second drive shaft 54, thereby allowing the second drive shaft 54 to rotate relative to the housing 22.

The second drive shaft 54 includes a third power transfer mechanism 66 operatively connected thereto, as shown in FIGS. 5A-5B. In an embodiment, the third power transfer mechanism 66 is a worm gear that is configured to correspond to and mesh with the second power transfer mechanism 62 of the first drive shaft 28 that is also a worm gear. It should be understood by one having ordinary skill in the art that the third power transfer mechanism 66 can be formed as any other type of mechanical component capable of transferring rotational power and rotation between the first and second drive shafts 28, 54 such as a spiral gear, a bevel gear, a spur gear, a worm gear, a planetary gear, or the like. In the illustrated embodiment, rotational power is transferred directly between the first drive shaft 28 to the second drive shaft 54 by way of the meshing engagement between the second and third power transfer mechanisms 64, 66. However, it should be understood by one having ordinary skill in the art that the second and third power transfer mechanisms 64, 66 may be different types of mechanical components and an intermediate mechanism may be positioned therebetween to both mesh with each power transfer mechanism as well as provide for an indirect transfer of rotational power and rotation between the first and second drive shafts 28, 54. In an embodiment, the worm gear of the second power transfer mechanism 64 and the worm gear of the third power transfer mechanism 66 are configured such that the first and second drive shafts 28, 54 rotate at substantially the same rotational velocity. It should be understood by one having ordinary skill in the art that the second and third power transfer mechanisms 64, 66 can also be configured such that the first drive shaft 28 rotates at a faster rotational velocity than the second drive shaft 54 or the first drive shaft 28 rotates at slower rotational velocity than the second drive shaft 54. In the illustrated embodiments, because the second drive shaft 54 is operatively driven by the first drive shaft 28, rotation of the second drive shaft 54—and the third stage assembly 36 attached thereto—is dependent upon the rotation of the first drive shaft 28. In other embodiments, the second drive shaft 54 is independently rotatable relative to the first drive shaft 28.

As shown in FIGS. 1-3, 4A-4B, and 5A-5B, a single second drive shaft 54 is rotatably attached to each of the opposing side walls of the housing 22 by way of a bearing 58 positioned between a distal end of the second drive shaft 54 and the housing 22, and a portion of the second drive shaft 54 is disposed within the gear housing 30. The second drive shaft 54 is oriented at an angle relative to the first drive shaft 28. In an embodiment, the second drive shaft 54 is oriented in a substantially perpendicular or transverse manner relative to the first drive shaft 28. In another embodiment, the second drive shaft 54 is formed of two separate lateral drive shafts, wherein each lateral drive shaft extends between the housing 22 and the gear housing 30. In some of these embodiments, the lateral drive shafts can be oriented at an angle relative to said first drive shaft, wherein the angle can be between about 45° and 90°. In yet another embodiment, the second drive shaft 54 is formed of separate lateral drive shafts that extend from each of the opposing side walls of the housing 22 generally toward the gear housing 28 without extending the entire distance between the side wall of the housing 22 and the gear housing 28. These lateral drive shafts are powered separately from the first drive shaft 28.

In other embodiments in which the second drive shaft 54 is formed of separate lateral drive shafts that only extend between the housing 22 and the gear housing 30, each of the separate lateral drive shafts include a power transfer mechanism operatively connected thereto (such as a bevel gear or the like) which allows for the transfer of rotational power and rotation from the first drive shaft 28 to each of the separate lateral drive shafts.

In an embodiment, the third drive shaft 56 is oriented longitudinally within the gear housing 30 and extends forward from the gear housing 30 in a generally parallel manner relative to the first drive shaft 28, as shown in FIGS. 3A-3B, 4, and 5A-5B. The third drive shaft 56 extends from the gear housing 30 in a cantilevered manner such that the bearings 58 and bosses 60 of the housing provide the structural support for the third drive shaft 56. A first bearing 58 is located within a boss 60 of the gear housing 30 and is positioned adjacent to the distal end of the third drive shaft 56 located within the gear housing 30. A second bearing 58 is located within a boss 60 of the gear housing 30 and is positioned adjacent to the portion of the third drive shaft 56 that exits the gear housing 30. The third drive shaft 56 includes a fourth power transfer mechanism 68 operatively connected thereto. The fourth power transfer mechanism 68 can be fixedly connected to the third drive shaft 56, removably connected to the third drive shaft 56, or integrally formed with the third drive shaft 56. In the illustrated embodiment, the fourth power transfer mechanism 68 is a pinion gear fixedly attached to the third drive shaft 56, wherein the pinion gear of the fourth power transfer mechanism 68 is meshingly engaged with the corresponding pinion gear of the first power transfer mechanism 62. In an embodiment, the number of gear teeth of both pinion gears is the same so that the first drive shaft 28 rotates at substantially the same rotational velocity as third drive shaft 56. In another embodiment, the number of gear teeth of the fourth power transfer mechanism 68 on the third drive shaft is greater than the number of gear teeth on the first power transfer mechanism 62 such that the first drive shaft 28 rotates at a slower rotational velocity than the third drive shaft 56. In still another embodiment, the number of gear teeth of the fourth power transfer mechanism 68 on the third drive shaft is less than the number of gear teeth on the first power transfer mechanism 62 such that the first drive shaft 28 rotates at a faster rotational velocity than the third drive shaft 56. It should be understood by one having ordinary skill in the art that an intermediate gear or gear set may be positioned between the first and fourth power transfer mechanisms 62, 68, wherein the intermediate gear or gear set may act as a reduction gear or a multiplier gear.

A third stage assembly 36 is operatively connected to the second drive shaft 56, as shown in FIGS. 3A-3B and 4. The third stage assembly 36 rotates about an axis defined by the second drive shaft 56, wherein the axis about which the third stage assembly 36 rotates is different than the axis about which the first and second stage assemblies 32, 34. The third stage assembly 36 is configured to push or otherwise move snow and ice axially with respect to the second drive shaft 54, which is laterally within the housing 22. The third stage assembly 36 is configured to include snow-moving elements positioned adjacent to both lateral sides of the gear housing 30 so that the snow is moved or pushed toward the gear housing 30 or the fore/aft centerline of the housing 22. In the illustrated exemplary embodiment, the third stage assembly 36 is formed of a pair of augers 48, wherein the augers 48 are positioned on the second drive shaft 56 between the gear housing 30 and the inner surface of the side walls of the housing 22 such that the augers 48 are located adjacent to opposing sides of the gear housing 30. In other words, one auger 48 is positioned on the second drive shaft 56 between the right lateral side of the gear housing 30 and the housing 22, and the other auger 48 is positioned on the second drive shaft 56 between the left lateral side of the gear housing 30 and the housing 22. The augers 48 are removably connected to the second drive shaft 56 by way of a connecting mechanism such as a nut-and-bolt, cotter pin, or the like. In another embodiment, the third stage assembly 36 includes a pair of augers 48 positioned between the gear housing 30 and one side wall of the housing 22 as well as another pair of augers 48 positioned between the gear housing 30 and the opposing side wall of the housing 22. It should be understood by one having ordinary skill in the art that the third stage assembly 36 can include any number of augers 48 positioned along the second drive shaft 56, and with any number of augers 48 located on each side of the gear housing 30. In some embodiments, the third stage assembly 36 includes all augers 48 that drive, push, or otherwise move snow laterally within the housing 22 toward the gear housing 30 and the centerline of the snow thrower 10. In another embodiment, the third stage assembly 36 includes at least one auger positioned adjacent to each lateral side of the gear housing as well as at least one other rotatable element paired with each lateral side of the second drive shaft 56. The other rotatable element may be formed as a brush, a paddle, or any other mechanism capable of assisting the augers 48 in moving the accumulated snow and/or ice toward the gear housing 30. The augers 48 of the third stage assembly 36 can be the same type or construction as the augers 48 used for any other stage assembly, or they can be formed differently. The augers 48 of the third stage assembly 36 rotate in response to rotation of the second drive shaft 54, and rotation of the augers 48 acts to both contact and cut up accumulated snow and ice as well as move and push the snow and ice within the housing 22 toward the gear housing 30.

A fourth stage assembly 38 is operatively connected to the third drive shaft 56, as shown in FIGS. 3A-3B and 4. The fourth stage assembly 38 rotates about the axis defined by the third drive shaft 56. In an embodiment, the axis defined by the third drive shaft 56 is oriented generally parallel to, but not collinear with, the axis of the first drive shaft 28 about which the first and second stage assemblies 32, 34 rotate. The fourth stage assembly 38 is configured to push or otherwise move snow and ice axially with respect to the third drive shaft 56, which is longitudinally within the housing 22. The fourth stage assembly 38 is configured to include at least one snow-moving element positioned adjacent to forwardly-directed wall of the gear housing 30 and is configured to move snow is toward the gear housing 30 generally along the fore/aft centerline of the housing 22. In the illustrated exemplary embodiment, the fourth stage assembly 38 is formed of an auger 48 removably attached to the third drive shaft 56, wherein the auger 48 positioned on the third drive shaft 58 forward, or upstream, of the gear housing 30. The auger 48 of the fourth stage assembly 38 is held in a cantilevered manner. It should be understood by one having ordinary skill in the art that although the fourth stage assembly 38 is shown as including only one auger 48, any number of augers 48 or other mechanism for breaking up accumulated snow and ice and moving or pushing the snow downstream in a rearward direction toward the second and first stage assemblies 34, 32. The fourth stage assembly 38 is positioned on the third drive shaft 56 such that the fourth stage assembly 38 is located longitudinally forward of the third stage assembly 36, as shown in FIG. 3B. In another embodiment, the fourth stage assembly 38 is positioned on the third drive shaft 56 such that the fourth stage assembly 38 is generally aligned with the third stage assembly 36 in the longitudinal direction, even though the third and fourth stage assemblies 36, 38 rotate about substantially perpendicular axes.

In the illustrated embodiments, because the third drive shaft 56 is operatively driven by the first drive shaft 28, rotation of the third drive shaft 56—and the fourth stage assembly 38 attached thereto—is dependent upon the rotation of the first drive shaft 28. However, because the third drive shaft 56 may not be directly connected to the second drive shaft 54, the third drive shaft 56—and the fourth stage assembly 38 attached thereto—can be independently rotatable relative to the second drive shaft 54—and the third stage assembly 36 attached thereto. In an embodiment, the third drive shaft 56 rotates separately from the first drive shaft 28 such that the fourth stage assembly 38 rotates separately from the second stage assembly 36.

In an embodiment, the fourth stage assembly 38 is configured to rotate at the same rotational velocity as the third stage assembly 36. In another embodiment, the fourth stage assembly 38 is configured to rotate at a different rotational velocity relative to the third stage assembly 36. The tip speed of the auger(s) 48 of the fourth stage assembly 38 can rotate at a different speed than the augers 48 of the third stage assembly 36 to compensate for travel speed of the snow thrower 10. The slower tip speed of the augers 48 of the third stage assembly 38 compared to the augers 48 of the fourth stage assembly 38 aids in the snow collection and transfer of the snow toward the gear housing 30 and centerline of the snow thrower 10. It should be understood by one having ordinary skill in the art that the auger(s) 48 of the fourth stage assembly 38 may also be configured to rotate slower than the augers 48 of the third stage assembly 36.

As shown in FIG. 5B, the second drive shaft 54 is positioned below the first drive shaft 28, and the third drive shaft 56 is positioned below the second drive shaft 28. As such, the fourth stage assembly 38 is located vertically lower than the first, second, and third stage assemblies 32, 34, 36. The result of the vertical positioning of the first, second, and third drive shafts 28, 54, 56 is that the auger 48 of the fourth stage assembly 38 is positioned as the vertically lowest auger 28 that contacts the accumulated snow, which allows the auger 48 of the fourth stage assembly 38 to be located closest to the driveway, walkway, or surface being cleared of snow. By positioning the auger 48 of the fourth stage assembly 38 closer to the surface being cleared by the snow thrower 10, more accumulated snow and ice can be cleared by the snow thrower 10 per pass, which reduces the number of times that the snow thrower 10 needs to go over the same area to ensure the maximum amount of snow removal. The lowered auger 48 of the fourth stage assembly 38 provides improved snow removal because the lowered auger 48 is positioned closer to the terrain which allows the auger to contact the accumulated snow at a shallower depth. As such, the snow thrower 10 is more efficient at clearing snow at smaller depths of accumulation.

In an embodiment, the snow thrower 10 also includes a baffle 70 positioned within the housing 22 and attached to an inner surface of the housing 22 such that it surrounds a portion of the outlet aperture 26 that leads to the expulsion housing 29, as shown in FIGS. 1-2 and 4. The baffle 70 is an arcuate, or curved member having a radius of curvature that is substantially the same as the radius of curvature of the outlet aperture 26. In an embodiment, the baffle 70 includes a plurality of tabs that are welded to the housing 22. In yet another embodiment, the baffle 70 is releasably connected to the housing 22 by way of bolts or other releasable mechanical connectors. In a further embodiment, the baffle 70 is integrally formed with the housing 22. The baffle 70 is configured to assist in reducing or restraining the amount of snow that is re-circulated within the housing 12 by limiting the amount of snow that slips off the tips 46 of the auger and re-enters the housing 22. The baffle 70 then directs the snow toward the impeller 40 of the first stage assembly 32 to be expelled via the chute 20. The baffle 70 can be made by any resilient material such as steel, aluminum, or any other type of metal or hard plastic that can withstand the stresses and temperature conditions of the snow thrower 10.

It should be understood by one having ordinary skill in the art that although the figures illustrate the direct meshing of corresponding gears between the first drive shaft 28 with the second and third drive shafts 54, 56, the transfer of rotational movement from the first drive shaft 28 may also be done indirectly to the second and third drive shafts 54, 56. For example, a multiplier (not shown) and/or a reducer (not shown) can be positioned between the first or second power transfer mechanism 62, 64 a corresponding power transfer mechanism on the second or third drive shaft 54, 56.

The impeller 40 and the auger 48 of the second stage assembly 34 positioned immediately adjacent thereto are oriented and timed such that they rotate at the same angular velocity, wherein as the snow slides from the end of the flight 50 of the auger 48 toward the impeller 40, the impeller 40 is positioned such that the snow enters the gap between adjacent blades 42 of the impeller 40 so that re-circulation of the snow is reduced.

In operation, the user grasps the handles 14 and powers up the power supply 12 to turn on the snow thrower. In an embodiment, the power supply 12 begins to provide rotational power to the first drive shaft 28 upon start-up. In another embodiment, the power supply 12 selectively provides rotational power to the first drive shaft 28, wherein the user determines when the rotational power generated by the power supply 12 is transferred to the first drive shaft 28. Once the power supply 12 and operatively engages the first drive shaft 28, the first drive shaft 28 begins to rotate. Rotation of the first drive shaft 28 causes the first and second stage assemblies 32, 34 to simultaneously rotate in the same manner as the first drive shaft 28.

The meshing engagement between the first and second power transfer mechanisms 62, 64 of the first drive shaft 28 with the third and fourth power transfer mechanisms 66, 68 of the second and third drive shafts 54, 56, respectively, causes the second and third drive shafts 54, 56 to rotate. Rotation of the second drive shaft 54 causes the third stage assembly 36 to rotate in a similar manner. Likewise, rotation of the third drive shaft 56 causes the fourth stage assembly 38 to rotate in a similar manner. Thus, once the power supply 12 begins to transfer rotation to the first drive shaft 28, the rotation of the first drive shaft 28 is then transferred to the second and third drive shafts 54. 56. When the first, second, and third drive shafts 28, 54, 56 are rotating, the first, second, third, and fourth stage assemblies 32, 34, 36, and 38 are also rotating as a result of being operatively connected to one of the drive shafts.

After the first, second, third, and fourth stage assemblies 32, 34, 36, and 38 have begun rotating, the snow thrower 10 can begin to remove accumulated snow and ice from a driveway, sidewalk, or the like. As the snow thrower 10 is moved into contact with the snow and ice, rotation of the fourth stage assembly 38 breaks up the accumulated snow and ice and begins pushing the snow and ice downstream, or longitudinally rearward, toward the first and second stage assemblies 32, 34. At the same time, the third stage assembly 38 also breaks up the accumulated snow and ice and beings pushing the snow and ice axially along the second drive shaft 54 toward the gear housing 30 in an outside-in manner in which the snow is pushed by the third stage assembly 38 from the side walls of the housing 22 toward the longitudinal centerline of the housing 22. As the snow is pushed and moved toward the center of the housing 22 by the third and fourth stage assemblies 36, 38, rotation of the second stage assembly 34 moves the snow and ice downstream, or longitudinally rearward, toward the first stage assembly 32. The second stage assembly 34 pushes the snow and ice rearwardly through the outlet aperture 26 of the housing 22 and into the expulsion housing 29 in which the first stage assembly 32 is located. Rotation of the first stage assembly 32 within the expulsion housing 29 drives the snow and ice radially outward such that the snow and ice is expelled from the expulsion housing 29 by way of the chute 20, and the snow and ice is thrown in a user-selected direction away from snow thrower 10.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A multiple-stage snow thrower comprising:

a frame;

a power supply operatively connected to the frame;

a first stage assembly positioned at least partially within a housing and operatively connected to the power supply, wherein rotation of the first stage assembly expels snow from the housing;

a second stage assembly operatively connected to the power supply, wherein rotation of the second stage pushes the snow toward the first stage assembly;

a third stage assembly operatively connected to the power supply, wherein rotation of the third stage assembly pushes the snow toward the second stage assembly; and a fourth stage assembly operatively connected to the power supply, wherein rotation of the fourth stage assembly pushes the snow toward the second stage assembly;

wherein the first stage assembly and the second stage assembly are attached to a first drive shaft, the first drive shaft having a first power transfer mechanism and a second power transfer mechanism;

wherein the third stage assembly is attached to a second drive shaft, the second drive shaft having a third power transfer mechanism; and wherein the fourth stage assembly is attached to a third drive shaft.

2. The multiple-stage snow thrower of claim 1, wherein the first and second power transfer mechanisms transfer rotational power from the first drive shaft to the second and third drive shafts.

3. The multiple-stage snow thrower of claim 1, wherein the first power transfer mechanism transfers rotational power from the first drive shaft to the third drive shaft.

4. The multiple-stage snow thrower of claim 1, wherein the first power transfer mechanism is formed separately from the first drive shaft and subsequently attached thereto, or the first power transfer mechanism is integrally formed with the first drive shaft.

5. The multiple-stage snow thrower of claim 1, wherein the first power transfer mechanism is attached to the first drive shaft after the first drive shaft is manufactured.

6. The multiple-stage snow thrower of claim 1, wherein the second power transfer mechanism engages with the third power transfer mechanism to transfer rotational power from the first drive shaft to the second drive shaft.

7. The multiple-stage snow thrower of claim 1, wherein the third power transfer mechanism engages with a fourth power transfer mechanism connected to the third drive shaft to transfer rotational power between the first drive shaft and the second drive shaft.

8. The multiple-stage snow thrower of claim 1, wherein rotation of the first drive shaft causes rotation of the second drive shaft.

9. The multiple-stage snow thrower of claim 1, further comprising a fourth power transfer mechanism operatively connected to the third drive shaft.

10. The multiple-stage snow thrower of claim 9, wherein the fourth power transfer mechanism is fixedly connected to the third drive shaft, removeably connected to the third drive shaft, or integrally formed with the third drive shaft.

11. A multiple-stage snow thrower for removing accumulated snow, the multiple-stage snow thrower having a housing, a frame, and a power supply operatively connected to the frame, the multiple-stage snow thrower comprising:

a first stage assembly operatively connected to a first drive shaft, wherein rotation of the first stage assembly moves the snow radially to expel the snow from the housing;

a second stage assembly operatively connected to the first drive shaft, wherein rotation of the second stage moves the snow within the housing;

a third stage assembly operatively connected to a second drive shaft, wherein rotation of the third stage assembly moves the snow within the housing; and a fourth stage assembly operatively connected to a third drive shaft, wherein rotation of the fourth stage assembly moves the snow within the housing;

wherein the first drive shaft comprises a first and a second power transfer mechanism, the second drive shaft comprises a third power transfer mechanism, and the third drive shaft comprises a fourth power transfer mechanism; and wherein the first power transfer mechanism is engaged with the third power transfer mechanism such that rotation of the first drive shaft causes rotation of the second drive shaft, and wherein the first power transfer mechanism is engaged with the fourth power transfer mechanism such that rotation of the first drive shaft causes rotation of the third drive shaft.

12. The multiple-stage snow thrower of claim 11, wherein the third drive shaft is positioned vertically lower than the first and second drive shafts.

13. The multiple-stage snow thrower of claim 11, wherein the first power transfer mechanism is formed from a pinion gear, a spiral gear, a bevel gear, a spur gear, a worm gear, or a planetary gear.

14. The multiple-stage snow thrower of claim 13, wherein the second power transfer mechanism is formed as a worm gear, wherein the worm gear of the second power transfer mechanism is in meshing engagement with third power transfer mechanism of the second drive shaft.

15. The multiple-stage snow thrower of claim 14, wherein the third power transfer mechanism is formed as a worm gear, wherein the worm gear of the third power transfer mechanism is in meshing engagement with the worm gear of the second power transfer mechanism.

16. The multiple-stage snow thrower of claim 11, wherein the first drive shaft rotates at a faster or slower rotational velocity than the second drive shaft.

17. The multiple-stage snow thrower of claim 11, wherein the first drive shaft rotates at a faster or slower rotational velocity than the third drive shaft.

18. The multiple-stage snow thrower of claim 11, wherein the fourth stage assembly rotates at the same rotational velocity as the third stage assembly.

19. The multiple-stage snow thrower of claim 11, wherein the fourth stage assembly rotates at a different rotational velocity relative to the third stage assembly.

* * * * *